US009290887B2

(12) United States Patent
Putschoegl et al.

(10) Patent No.: US 9,290,887 B2
(45) **Date of Patent: *Mar. 22, 2016**

(54) ROLL COVERING WITH IMPROVED DYNAMIC PROPERTIES AND GOOD RECOVERY PERFORMANCE

(71) Applicant: VOITH PATENT GMBH, Heidenheim (DE)

(72) Inventors: Peter Putschoegl, Wimpassing (AT); Stephan Ully, Graz (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/375,928

(22) PCT Filed: Jan. 24, 2013

(86) PCT No.: PCT/EP2013/051313

§ 371 (c)(1),
(2) Date: Jul. 31, 2014

(87) PCT Pub. No.: WO2013/113608

PCT Pub. Date: Aug. 8, 2013

(65) Prior Publication Data

US 2014/0345821 A1 Nov. 27, 2014

(30) Foreign Application Priority Data

Jan. 31, 2012 (DE) ..... 10 2012 201 310

(51) Int. Cl.

| | |
|---|---|
| ***D21F 3/08*** | (2006.01) |
| ***D21H 23/58*** | (2006.01) |
| ***D21G 1/02*** | (2006.01) |
| ***D21F 5/00*** | (2006.01) |

(52) U.S. Cl.
CPC .. *D21F 3/08* (2013.01); *D21F 5/00* (2013.01); *D21G 1/0233* (2013.01); *D21G 1/0246* (2013.01); *D21H 23/58* (2013.01)

(58) Field of Classification Search
USPC ..... 162/361, 312; 524/495, 507, 309
IPC ..... D21F 3/08; D21G 1/02
See application file for complete search history.

(56) References Cited

U.S. PATENT DOCUMENTS

| | | | | |
|---|---|---|---|---|
| 6,328,681 | B1 | 12/2001 | Stephens | |
| 6,538,071 | B1 | 3/2003 | Fuchs | |
| 2015/0018184 | A1 * | 1/2015 | Putschoegl et al. ..... | 492/48 |

FOREIGN PATENT DOCUMENTS

| | | | |
|---|---|---|---|
| DE | 19942743 | A1 | 3/2001 |
| WO | 0043593 | A1 | 7/2000 |

* cited by examiner

*Primary Examiner* — Mark Halpern
(74) *Attorney, Agent, or Firm* — Laurence A. Greenberg; Werner H. Stemer; Ralph E. Locher

(57) ABSTRACT

A roll covering is particularly suitable for a roll for the treatment of a paper web, paperboard web, or any other web of fibrous material in a machine for the production and/or finishing the same. The roll covering encompasses at least one layer. The at least one layer is formed of a rubber composition that includes at least one (meth)acrylate compound and a rubber component with at least one crosslinked hydrogenated nitrile rubber. Further, the at least one layer has a recovery rate of at least 12 mm per second and/or a maximal degree of plastic deformation of 0.9%, and a maximal tan δ value of 0.16 determined in accordance with DIN 53513 at 60° C. in tension at 10 Hz, 15% static elongation, and 1% dynamic elongation.

19 Claims, 1 Drawing Sheet

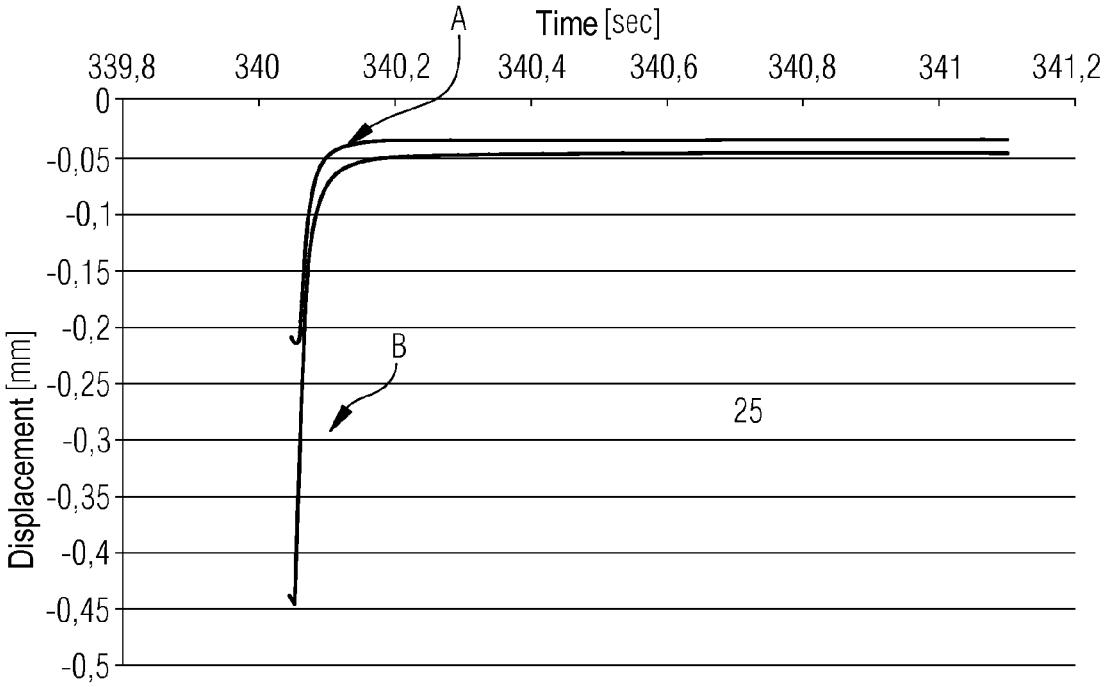
A
Time [sec]
339,8
340
340,2
340,4
340,6
340,8
341
341,2
0
-0,05
-0,1
-0,15
-0,2
-0,25
-0,3
-0,35
-0,4
-0,45
-0,5
Displacement [mm]
B
25

ROLL COVERING WITH IMPROVED DYNAMIC PROPERTIES AND GOOD RECOVERY PERFORMANCE

This application is a 371 of PCT/EP203/051313 filed 24 Jan. 2013.

BACKGROUND OF THE INVENTION

Field of the Invention

The present invention relates to a roll covering that is in particular suitable for a roll for the treatment of a paper web, paperboard web, or any other web of fibrous material in a machine for the production and/or finishing of same, to a process for the production of this roll covering, to a roll encompassing this roll covering, and to the use of this roll.

Many steps in papermaking use rolls, and in particular rubber rolls with a resilient surface, for example during sheet formation in the wire section of the papermaking machine, during draining in the press section of the papermaking machine, and during coating, drying, and calendaring in the final section of the papermaking machine. Many of the rolls used during papermaking are pressed against a counter roll during operation, while a web of fibrous material or a paper web is passed through the nip formed between the roll and the counter roll. In a film press by way of example used for the surface treatment of paper webs a film made by way of example of size or coating slip is produced for example by means of doctoring rollers on applicator rolls rotating at high speed, and is transferred in the nip onto the paper web passed through the nip. Rolls of this type are exposed to enormous loads during their use, and therefore have to comply with many mechanical and dynamic requirements. In particular, these rolls have to have not only good mechanical properties, such as high tensile strength and ultimate tensile strength, abrasion resistance, tear strength, compressive strength, and impact resistance, but also excellent dynamic properties, particular examples being low hysteresis and low tan δ, inter alia in order to minimize heat buildup during operation of the roll. These rolls must moreover exhibit good and rapid recovery. These good dynamic properties, and in particular good and rapid recovery, are also necessary in order that the roll surface region deformed in the nip by the pressure of the counter roll returns as rapidly as possible and as fully as possible to its original shape and dimension after leaving the nip, and specifically also after operation of the roll for a very long period. The usual method of providing the surfaces of rolls with the performance properties required for their use is to provide, on the surface of the rolls, a roll covering arranged on a roll core and composed of material formulated with a view to the required performance characteristics. Roll coverings of this type are usually composed of materials which comprise a matrix made of a rubber or of a mixture of two or more rubbers, into which one or more fillers has/have been embedded.

However, the mechanical and dynamic properties of rubber rolls involve inversely correlated properties, because an improvement in the mechanical properties of a rubber roll is usually attended by impairment of the dynamic properties of the roll, and on the other hand an improvement in the dynamic properties of a rubber roll usually causes impairment of the mechanical properties of the roll.

U.S. Pat. No. 6,538,071 B1 by way of example discloses a roll covering made of a rubber composition which comprises a crosslinked nitrile rubber, for example crosslinked hydrogenated nitrile rubber, a metal acrylate salt, such as zinc diacrylate, a liquid acrylate compound, and a filler. However, neither the mechanical properties nor the dynamic properties of said rubber composition are entirely satisfactory.

BRIEF SUMMARY OF THE INVENTION

It is therefore an object of the present invention to provide a roll covering which not only has excellent mechanical properties but also features excellent dynamic properties, and therefore has excellent suitability for use in a roll used in a high-speed sizing or coating assembly of a papermaking machine or paperboard machine.

This object is achieved in the invention via a roll covering, in particular for a roll for the treatment of a paper web, paperboard web, or any other web of fibrous material in a machine for the production and/or finishing of same, where said roll covering encompasses at least one layer, and the at least one layer comprises a rubber composition which comprises at least one (meth)acrylate compound and a rubber component encompassing at least one crosslinked hydrogenated nitrile rubber, and where the at least one layer has a) a recovery rate of at least 12 mm/sec. and/or a maximal degree of plastic deformation of 0.9%, and
b) a maximal tan δ value of 0.16 determined in accordance with DIN 53513 at 60° C. in tension at 10 Hz, 15% static elongation, and 1% dynamic elongation.

This achievement of the object is based on the surprising discovery that it is possible to obtain a roll covering made of a rubber composition with not only excellent mechanical properties but also at the same time excellent dynamic properties, namely a low tan δ value and low hysteresis, and in particular with excellent recovery performance, by mixing a (meth)acrylate compound with a very high degree of dispersion with a rubber component encompassing at least one crosslinked hydrogenated nitrile rubber, and optionally with other conventional filler(s) and additive(s). The rubber(s) here form(s) the rubber component which forms the matrix of the at least one layer of the roll covering, and said matrix comprises, in embedded form, the at least one (meth)acrylate compound and optionally other fillers and additives. The excellent mechanical and dynamic properties of the roll covering of the invention and in particular its excellent recovery performance, make it particularly suitable for use in a roll which is used in a high-speed sizing or coating assembly of a papermaking machine or paperboard machine, and which is exposed, during its use, to enormous centrifugal forces and deformation forces.

For the purposes of the present invention, rubber is any vulcanized rubber, and specifically irrespective of whether this means a vulcanized natural rubber or a vulcanized synthetic rubber.

For the purposes of the present invention the expression rubber component moreover denotes the entirety of all of the crosslinked and uncrosslinked rubbers present in the rubber composition, i.e. the matrix of the at least one layer of the roll covering, whereas the expression rubber composition denotes the entirety of all of the compounds present in the at least one layer of the roll covering, i.e. the entirety of the crosslinked and uncrosslinked rubbers, of the at least one (meth)acrylate compound embedded therein, and of the optional other fillers and additives.

For the purposes of the present invention the term (meth) acrylate compound moreover means any of the compounds which have at least one acrylate group and/or at least one methacrylate group, i.e. in particular any of the molecular compounds, ionic compounds, and, respectively, salts and complex compounds having at least one acrylate group and/or at least one methacrylate group.

In a first particularly preferred embodiment of the present invention, the at least one layer of the roll covering of the invention has a recovery rate of at least 12 mm/sec., and this can, as described above, be achieved in that the at least one (meth)acrylate compound is mixed with a sufficiently high degree of dispersion with the rubber component encompassing at least one crosslinked hydrogenated nitrile rubber. Corresponding specific production processes are described at a later stage below. Particularly good results are obtained with this embodiment when the at least one layer of the roll covering has a recovery rate of at least 14 mm/sec., preferably a recovery rate of at least 16 mm/sec. and particularly preferably a recovery rate of at least 18 mm/sec.

The recovery rate here is determined as follows in the present invention: the at least one layer of the roll covering is first used to produce five cylindrical test samples each of diameter 13 mm and each of height 6 mm. A caliper gauge is then used to determine the exact thickness of each test sample. Each of the test samples in succession is then subjected to pressure load in a dynamic tester, e.g. an MTS-831 dynamic tester from MTS, at 30° C.±2° C., using the force-time curve below, where each cycle first applies a rectangular force pulse for a period of 100 milliseconds and then a holding phase is implemented for a period of 900 milliseconds with a force of 5 N, in order to avoid lifting of the hydraulic ram of the tester from the test sample, and the displacement signals and force signals are recorded during the cycle:

1. 300 cycles each using a force pulse of 100 N, where the displacement signals and force signals are recorded with a resolution of 20 Hz in each cycle, then
2. 5 cycles each with a force pulse of 100 N, where the displacement signals and force signals are recorded with a resolution of 200 Hz in each cycle, then
3. 300 cycles each with a force impulse of 200 N, where the displacement signals and force signals are recorded with a resolution of 20 Hz in each cycle, then
4. 5 cycles each with a force pulse of 200 N, where the displacement signals and force signals are recorded with a resolution of 200 Hz in each cycle, then
5. 300 cycles each with a force pulse of 300 N, where the displacement signals and force signals are recorded with a resolution of 20 Hz in each cycle, then
6. 5 cycles each with a force impulse of 300 N, where the displacement signals and force signals are recorded with a resolution of 200 Hz in each cycle, and then
7. 10 minutes of holding time at 5 N.

BRIEF DESCRIPTION OF THE DRAWING

The FIGURE is a graph illustrating displacement signals and force signals for a cycle with one curve representing a lesser force and the other curve representing a greater force.

DESCRIPTION OF THE INVENTION

The terms displacement signals and force signals here mean the pairs of values for the thickness of the test sample with the force applied at a given time. The FIGURE shows an example of a graph depicting a large number of displacement signals and force signals for respectively a cycle using a force of 100 N (curve A) and a cycle using a force of 200 N (curve B). The conduct of the cycles, each with a holding phase of duration 900 milliseconds and with a force pulse phase of duration 100 milliseconds simulates the passage of the roll covering through the nip and the subsequent unrestricted movement of the roll covering outside of the nip.

The resultant data are used to calculate the time required for each individual test sample to return to 80% of its original thickness after each of the five cycles each using a force pulse of 300 N in which the displacement signals and force signals were recorded with a resolution of 200 Hz. For each of the five test samples, the arithmetic average value is calculated from the five individual values thus determined, in order to determine the recovery rate for each test sample. The arithmetic average value is then calculated from the five recovery rates. This value is the recovery rate specified above.

In a second particularly preferred embodiment of the present invention, the at least one layer of the roll covering of the invention has a maximal degree of plastic deformation of 0.9%, and as described above this can be achieved in that the at least one (meth)acrylate compound is mixed with a sufficiently high degree of dispersion with the rubber component encompassing at least one crosslinked hydrogenated nitrile rubber. Specific production processes are described at a later stage below. Particularly good results are obtained with this embodiment when the at least one layer has a maximal degree of plastic deformation of 0.7%, preferably of 0.5%, and particularly preferably of 0.3%.

The procedure for determining the degree of deformation is as above for determining the recovery rate, but in each case after the final 10 minutes of holding time at 5 N as in 7. the thickness of the individual test samples is measured and used to calculate the percentage quotient derived by dividing the difference between the initial height and the height after the holding time by the initial height. In other words, the degree of deformation is determined as $((H_a-H_n)/H_a)\cdot 100$, where $H_a$ denotes the initial thickness of the test sample and $H_n$ denotes the thickness of the test sample after conduct of the force cycles. The five degrees of deformation thus determined are then used to calculate the arithmetic average value. This value is the degree of deformation specified above.

In a third particularly preferred embodiment of the present invention, the at least one layer of the roll covering of the invention has not only a recovery rate of at least 12 mm/sec., preferably of at least 14 mm/sec., particularly preferably of at least 16 mm/sec., and very particularly preferably of at least 18 mm/sec., but also a maximal degree of plastic deformation of 0.9%, preferably of 0.7%, particularly preferably of 0.5%, and very particularly preferably of 0.3%.

As described above, the at least one layer of the roll covering of the invention moreover has, in the invention, a maximal tan δ value of 0.16, determined in accordance with DIN 53513 at 60° C. in tension at 10 Hz, 15% static elongation, and 1% dynamic elongation. The tan δ value is a measure of the heat buildup that occurs in the rubber composition and that in turn correlates with the hysteresis of the rubber composition, where a low tan δ value correlates with low hysteresis and with low heat buildup. Like the recovery rate specified above and the degree of plastic deformation specified above, said low tan δ value can be achieved in that the at least one (meth)acrylate compound is mixed with a sufficiently high degree of dispersion with the rubber component encompassing at least one crosslinked hydrogenated nitrile rubber. Particularly good results are achieved when the at least one layer has a maximal tan δ value of 0.14, preferably of 0.12, and particularly preferably of 0.10.

In order to achieve good wear resistance, it is proposed in a continuation of the concept of the invention that the at least one layer of the roll covering of the invention has a tear strength of more than 14 N/mm, preferably of more than 15 N/mm, and particularly preferably of more than 16 N/mm.

For the purposes of the present invention, the tear strength is determined in accordance with DIN ISO 34-1, Method B, Procedure B.

As described above, it is essential to the invention that the at least one layer of the roll covering of the invention comprises at least one crosslinked hydrogenated nitrile rubber in which the at least one (meth)acrylate compound has been embedded in very finely dispersed form. In this context, the term hydrogenated nitrile rubber means either fully hydrogenated nitrile rubber or else partially hydrogenated nitrile rubber. It is preferable that the crosslinked hydrogenated nitrile rubber is crosslinked partially hydrogenated nitrile rubber where the degree of hydrogenation is preferably from 85 to less than 100%, and particularly preferably from 90 to less than 100%.

In respect of the mechanical and dynamic properties of the roll covering it has moreover proven advantageous to add, to the rubber composition of the at least one layer of the roll covering, a crosslinked hydrogenated nitrile rubber with acrylonitrile content of from 20 to 50% by weight, preferably from 30 to 40% by weight, and particularly preferably from 33 to 37% by weight, and accordingly with butadiene content of from 50 to 80% by weight, preferably from 60 to 70% by weight, and particularly preferably from 67 to 63% by weight.

For the same reasons it is proposed, continuing the concept of the invention, that the at least one crosslinked hydrogenated nitrile rubber has a Mooney viscosity of from 20 to 80, and preferably from 30 to 70, determined in accordance with DIN 53253-3.

In principle, the rubber component of the rubber composition can be composed entirely of one crosslinked hydrogenated nitrile rubber or of two or more different crosslinked hydrogenated nitrile rubbers, where the rubber component and thus also the rubber composition comprise no rubber other than a crosslinked hydrogenated nitrile rubber or a plurality of crosslinked hydrogenated nitrile rubbers.

To the extent that the present embodiment uses only one type of hydrogenated nitrile rubber, the rubber composition can be produced by mixing the at least one (meth)acrylate compound into the uncrosslinked hydrogenated nitrile rubber and achieving very fine dispersion of said (meth)acrylate compound, before the resultant mixture is vulcanized. However, it is preferable first to mix the at least one (meth)acrylate compound only into a portion of the uncrosslinked hydrogenated nitrile rubber, and to achieve very fine dispersion of said (meth)acrylate compound, before this mixture is then mixed with the remaining quantity of the hydrogenated nitrile rubber and vulcanized. In principle it is also possible to produce the rubber composition by mixing the at least one (meth) acrylate compound into the crosslinked hydrogenated nitrile rubber, and achieving very fine dispersion of said (meth) acrylate compound; however, this alternative is less preferred.

To the extent that the present embodiment uses two or more types of hydrogenated nitrile rubber, the rubber composition can be produced by first mixing the at least one (meth)acrylate compound into a first, uncrosslinked hydrogenated nitrile rubber, and achieving a high degree of dispersion of said (meth)acrylate compound, before a second, and optionally one or more further, uncrosslinked hydrogenated nitrile rubber(s) is/are mixed into the resultant mixture, and the resultant mixture is finally vulcanized. In an alternative to this it is also possible, although less preferred, that the at least one (meth)acrylate compound is first mixed into a first, uncrosslinked hydrogenated nitrile rubber, and a high degree of dispersion of said (meth)acrylate compound is achieved, before this mixture is vulcanized and then mixed with a second, and optionally one or more further, crosslinked hydrogenated nitrile rubber(s). Finally, it is also possible, although even less preferred, that the at least one (meth) acrylate compound is first mixed into a first, crosslinked hydrogenated nitrile rubber, and a high degree of dispersion of said (meth)acrylate compound is achieved, before this mixture is mixed with a second crosslinked hydrogenated nitrile rubber.

In an embodiment of the present invention that is an alternative to the above embodiment, the rubber component of the rubber composition comprises, in addition to the at least one crosslinked hydrogenated nitrile rubber, at least one other rubber which differs from crosslinked hydrogenated nitrile rubber and which is preferably selected from the group consisting of crosslinked nitrile rubbers, crosslinked carboxylated nitrile rubbers, crosslinked styrene-butadiene rubbers, and any desired copolymers and/or mixtures of two or more of the abovementioned crosslinked rubbers.

Production of the rubber composition can be achieved by analogy with the variants described above in respect of the embodiment in which the rubber component is composed exclusively of hydrogenated nitrile rubber(s). In other words, the rubber composition can be produced by first mixing the at least one (meth)acrylate compound into an uncrosslinked hydrogenated nitrile rubber, and achieving a high degree of dispersion of said (meth)acrylate compound, before a second, and optionally one or more further, uncrosslinked rubber which differs from hydrogenated nitrile rubber is/are mixed into the resultant mixture, and the resultant mixture is finally vulcanized. In an alternative to this it is also possible, however less preferred, that the at least one (meth)acrylate compound is first mixed into an uncrosslinked hydrogenated nitrile rubber, and very fine dispersion of said (meth)acrylate compound is achieved, before this mixture is vulcanized, and then is mixed with a second, and optionally one or more further, rubber which differs from hydrogenated nitrile rubber. Finally, it is also possible, although even less preferred, that the at least one (meth)acrylate compound is first mixed into a crosslinked hydrogenated nitrile rubber, and very finely dispersed, before this mixture is mixed with a second rubber which differs from crosslinked hydrogenated nitrile rubber.

In this embodiment the rubber component preferably comprises from 1 to 60% by weight, particularly preferably from 5 to 50% by weight, and very particularly preferably from 15 to 40% by weight, of one, or a plurality of different, crosslinked hydrogenated nitrile rubber(s), and preferably from 40 to 99% by weight, particularly preferably from 50 to 95% by weight, and very particularly preferably from 60 to 85% by weight of one or more rubbers selected from the group consisting of crosslinked nitrile rubbers, crosslinked carboxylated nitrile rubbers, crosslinked styrene-butadiene rubbers, and any desired copolymers and/or mixtures of two or more of the abovementioned crosslinked rubbers.

As described above, the at least one (meth)acrylate compound present in the at least one layer of the roll covering of the invention can be any desired molecular compound, ionic compound, or complex compound having at least one acrylate group and/or at least one methacrylate group. However, good results are in particular obtained when the at least one (meth)acrylate compound is selected from the group consisting of zinc monoacrylates, zinc diacrylates, zinc monomethacrylates, zinc dimethacrylates, lithium acrylates, lithium methacrylates, sodium acrylates, sodium methacrylates, potassium acrylates, potassium methacrylates, magnesium acrylates, magnesium methacrylates, calcium acrylates, calcium methacrylates, aluminum acrylates, aluminum methacrylates, copper acrylates, copper methacrylates, ammonium acrylates, ammonium methacrylates, quaternary ammonium acrylates, quaternary ammonium methacrylates, alkyldiol monoacrylates, alkyldiol diacrylates, alkyldiol monomethacrylates, alkyldiol dimethacrylates, trimethylolpropane trimethacrylates, and any desired mixtures of two of more of the abovementioned compounds.

The at least one (meth)acrylate compound is particularly preferably selected from the group consisting of zinc monoacrylates, zinc diacrylates, zinc monomethacrylates, zinc dimethacrylates, butanediol dimethacrylates, trimethylolpropane trimethacrylates, and any desired mixtures of two or more of the abovementioned compounds. The zinc monoacrylates and zinc monomethacrylates have a monovalent (meth)acrylate anion and a divalent zinc ion, and can have any desired monovalent anion as second negative group to produce charge neutrality, a preferred example being a hydroxide ion, a chloride ion, a bromide ion, or an iodide ion.

In order to achieve the desired improvement in both dynamic and also recovery performance, it is proposed, continuing the concept of the invention, that the rubber composition comprises, based on 100 parts by weight of the rubber component, from 1 to 20 parts by weight, preferably from 5 to 15 parts by weight, and particularly preferably from 7.5 to 12.5 parts by weight, for example 10 parts by weight, of the at least one (meth)acrylate compound.

The rubber composition of the at least one layer of the roll covering of the invention can optionally comprise further fillers and/or additives alongside the at least one crosslinked hydrogenated nitrile rubber and the at least one (meth)acrylate compound.

In order to reinforce the matrix and in order to tailor the properties of the roll covering in respect of the planned use of the roll encompassing the roll covering, it can be advantageous to add a reinforcing filler to the at least one layer of the roll covering of the invention. The reinforcing filler can by way of example be carbon black and/or silica, or else an inorganic compound such as calcium carbonate, or a mineral such as mica.

It is preferable that the at least one layer of the roll covering of the invention comprises, based on 100 parts by weight of the rubber component, from 1 to 150 parts by weight, preferably from 10 to 100 parts by weight, particularly preferably from 20 to 70 parts by weight, and very particularly preferably from 40 to 50 parts by weight, of carbon black, for example 45 parts by weight of carbon black. Carbon black that can be used here is any of the types of carbon black known to the person skilled in the art, and preferably carbon black with a specific BET surface area of from 5 to 120 $m^2/g$.

In addition to the abovementioned embodiment, or as alternative thereto, the at least one layer of the of the invention can comprise, based on 100 parts by weight of the rubber component, from 1 to 100 parts by weight, preferably from 5 to 40 parts by weight, and particularly preferably from 10 to 20 parts by weight, of silica, for example 15 parts by weight of silica. Silica used here can be any of the types of silica known to the person skilled in the art, and preferably silica with a specific BET surface area of from 5 to 210 $m^2/g$.

When the at least one layer of the roll covering of the invention comprises silica, it is moreover preferable to use this in combination with a silane coupling agent, in order to increase the compatibility of the rubber matrix with the silica and thus to improve the dispersion of the silica in the matrix. Silane coupling agent used can be any of the compounds known to the person skilled in the art, for example sulfide-type silane coupling agents, such as bis(3-triethoxysilylpropyl)tetrasulfide, bis(2-triethoxysilylethyl)tetrasulfide, bis(3-trimethoxysilylpropyl)tetrasulfide, bis(2-trimethoxysilylethyl)tetrasulfide, bis(3-triethoxysilylpropyl)trisulfide, bis(3-trimethoxysilylpropyl)trisulfide and the like, mercapto-type silane coupling agents, such as 3-mercaptopropyltrimethoxysilane, 3-mercaptopropyltriethoxysilane, 2-mercaptoethyltrimethoxysilane, 2-mercaptoethyltriethoxysilane and the like, vinyl-type silane coupling agents, such as vinyltriethoxysilane, vinyltrimethoxysilane, and the like, amino-type silane coupling agents, such as 3-aminopropyltriethoxysilane, 3-aminopropyltrimethoxysilane, and the like, glycidoxy-type silane coupling agents, such as γ-glycidoxypropyltriethoxysilane, γ-glycidoxypropyltrimethoxysilane, and the like, nitro-type silane coupling agents, such as 3-nitropropyltrimethoxysilane, 3-nitropropyltriethoxysilane, and the like, and chloro-type silane coupling agents, such as 3-chloropropyltrimethoxysilane, 3-chloropropyltriethoxysilane, and the like.

The rubber composition can moreover comprise—as an alternative to, or in addition to, carbon black and/or silica—at least one filler and/or additive preferably selected from the group consisting of plasticizers, antioxidants, resins, polymer fillers, pigments and any desired mixtures of two of more of the abovementioned compounds.

Plasticizers or antioxidants that can have been added to the rubber composition of the at least one layer of the roll covering of the invention are any of the plasticizers and/or antioxidants known for this purpose to the person skilled in the art, where the preferred quantity present of the plasticizer is from 0 to 30 parts by weight and with preference from 0 to 15 parts by weight, and the preferred quantity present of the antioxidant is from 0 to 5 parts by weight and with preference from 1 to 4 parts by weight, based in each case on 100 parts by weight of the rubber component.

In order to adjust the hardness of the at least one layer of the roll covering of the invention to a desired value, it can by way of example be preferable to add at least one resin to the rubber composition of the at least one layer. Good results are in particular obtained here when the at least one resin is a phenolic resin and/or an acrylate resin. In this embodiment the quantity of the at least one resin is preferably from more than 0 to 80 parts by weight, particularly preferably from 2 to 40 parts by weight, and very particularly preferably from 5 to 30 parts by weight, based on 100 parts by weight of the rubber component.

In order to increase the abrasion resistance of the at least one layer of the roll covering of the invention and to adjust same to a desired value, it is proposed, continuing the concept of the invention, that the rubber composition comprises, based on 100 parts by weight of the rubber component, from more than 0 to 80 parts by weight, preferably from 2 to 40 parts by weight, and particularly preferably from 5 to 30 parts by weight, of at least one polymer filler. The at least one polymer filler here is preferably selected from the group consisting of polyolefins, polyamides, polyurethanes, polyesters, rubbers, and any desired mixtures of two or more of the abovementioned compounds. Examples that may be mentioned of suitable rubbers for the polymer filler are crosslinked natural rubbers, crosslinked styrene-butadiene rubbers, crosslinked chloroprene rubbers, crosslinked nitrile rubbers, crosslinked hydrogenated nitrile rubbers, crosslinked carboxylated nitrile rubbers, and any desired copolymers and/or mixtures of two or more of the abovementioned crosslinked rubbers. The polymer filler is particularly preferably made of polyethylene or of polypropylene, and is very particularly preferably made of a high-density polyethylene.

The median particle diameter ($d_{50}$) of the polymer filler is preferably from 1 μm to 500 μm, and with preference from 10 μm to 150 μm. In agreement with the conventional definition of this parameter, the term median particle diameter $d_{50}$ of the polymer filler means the particle diameter value that is greater than the value for 50% of the particles present in the polymer filler, i.e. 50% of all the particles in the polymer filler have a smaller diameter than the $d_{50}$ value. The roll covering in the invention encompasses at least one layer composed of the rubber composition described above. Since said layer has very good mechanical properties and also excellent dynamic properties, for example in particular a low tan δ value, and in particular has excellent recovery performance, this at least one layer preferably forms the outer layer of the roll covering. Good results are in particular achieved in this embodiment when the thickness of the at least one layer is from 5 to 25 mm.

In an alternative and particularly preferred embodiment of the present invention, the roll covering is composed of the at least one layer, and in this embodiment it is particularly preferable that the thickness of the roll covering is from 5 to 25 mm.

As described above, the roll covering of the invention can in particular be produced by a process in which the at least one (meth)acrylate compound is mixed with a high degree of dispersion into uncrosslinked hydrogenated nitrile rubber, and is finely dispersed therein, before further uncrosslinked hydrogenated nitrile rubber or another uncrosslinked rubber is optionally added to the resultant mixture, and the resultant mixture is vulcanized.

The present invention further provides a process for the production of the roll covering described above of the invention, which encompasses the following steps:

a) provision of an uncrosslinked hydrogenated nitrile rubber,
b) mixing and dispersion of at least one (meth)acrylate compound into the uncrosslinked hydrogenated nitrile rubber provided in the step a),
c) mixing of at least one crosslinking agent and optionally of another rubber into the material, where said rubber is preferably selected from the group consisting of uncrosslinked hydrogenated nitrile rubbers, uncrosslinked nitrile rubbers, uncrosslinked carboxylated nitrile rubbers, uncrosslinked styrene-butadiene rubbers, and any desired copolymers and/or mixtures of two or more of the above-mentioned crosslinked rubbers, and
d) vulcanization of the mixture produced in the step c).

It is also possible that the steps a) and b) are carried out simultaneously here.

It is possible here that the uncrosslinked hydrogenated nitrile rubber added in the step c) is the same as the uncrosslinked hydrogenated nitrile rubber provided in the step a), or that it differs therefrom by way of example in respect of molecular weight or acrylonitrile content. It is moreover possible to carry out the steps b) and c) simultaneously or in succession.

In an alternative embodiment of the present invention, a process for the production of the roll covering described above of the invention encompasses the following steps:

a) provision of an uncrosslinked hydrogenated nitrile rubber,
b) mixing and dispersion of at least one (meth)acrylate compound into the uncrosslinked hydrogenated nitrile rubber provided in the step a), and mixing of at least one crosslinking agent into the mixture,
c) vulcanization of the mixture produced in the step b), and
d) mixing of the mixture obtained in the step c) with a rubber which is preferably selected from the group consisting of crosslinked hydrogenated nitrile rubbers, crosslinked nitrile rubbers, crosslinked carboxylated nitrile rubbers, crosslinked styrene-butadiene rubbers, and any desired copolymers and/or mixtures of two or more of the above-mentioned crosslinked rubbers.

In this embodiment it is again possible to carry out the steps a) and b) simultaneously.

Again in this embodiment the crosslinked hydrogenated nitrile rubber added in the step d) can be the same as the crosslinked hydrogenated nitrile rubber produced by vulcanization in the step c) or can differ therefrom by way of example in respect of molecular weight or acrylonitrile content. In the step b), the mixing of the at least one crosslinking agent into the mixture can take place simultaneously or separately, i.e. before or after, the mixing of the at least one (meth)acrylate compound into the mixture.

The two process variants above can use, as vulcanizing agent, any compound known for this purpose to the person skilled in the art, and specifically in particular sulfur, one or more vulcanizing agents based on polysulfides, one or more vulcanizing agents based on thiourea compounds, one or more vulcanizing agents based on triazine derivatives, and/or one or more vulcanizing agents based on peroxide compounds, particular preference being given here to vulcanizing agents based on peroxide compounds.

It is moreover possible in the appropriate steps to add one or more vulcanization accelerators in addition to the vulcanizing agent. Vulcanization accelerators that can be used here are any of the compounds known for this purpose to the person skilled in the art. Mention may be made of the following merely by way of example: sulfenamide compounds, such as N-cyclohexyl-2-benzothiazylsulfenamide, thiazol compounds, such as 2-mercaptobenzothiazole, and thiuram compounds, such as tetramethylthiuram monosulfide and tetramethylthiuram disulfide.

The vulcanization can be carried out under the usual conditions of pressure and temperature known to the person skilled in the art, and specifically by way of example in an autoclave at a temperature of from 40 to 170° C., and preferably from 90 to 160° C., and at a pressure of from 2 to 10 bar, and preferably from 3 to 5 bar.

The present invention also provides a roll covering obtainable by any of the processes described above. A feature of the roll covering of the invention is that the at least one (meth) acrylate compound is present in very fine dispersion in the rubber component, thus providing the excellent mechanical and dynamic properties described above and in particular the excellent recovery performance described above.

The present invention also provides a roll with a roll core and with a resilient roll covering, of the composition described above, formed on the roll core.

The present invention further provides the use of the roll described above in a papermaking machine or paperboard machine, and preferably in a film press, in a size press, in a coating assembly, or in a coater.

What is claimed is:

1. A roll covering, comprising:

at least one layer of a rubber composition containing at least one (meth)acrylate compound and a rubber component;

said rubber component encompassing at least one crosslinked hydrogenated nitrile rubber and said (meth) acrylate compound being finely dispersed in said nitrile rubber, configuring said at least one layer to have:

a) a recovery rate of at least 12 mm/s and/or a maximal degree of plastic deformation of 0.9%; and b) a maximal tan δ value of 0.16 determined in accordance with DIN 53513 at 60° C. in tension at 10 Hz, 15% static elongation, and 1% dynamic elongation.

2. The roll covering according to claim 1, wherein said at least one layer has at least one feature selected from the group consisting of a recovery rate of at least 14 mm/sec, a maximal degree of plastic deformation of 0.7%, a maximal tan δ value of 0.14, and a tear strength of more than 14 N/mm.

3. The roll covering according to claim 1, wherein said at least one layer has a recovery rate of at least 18 mm/sec, a maximal degree of plastic deformation of 0.3%, a maximal tan δ value of 0.10, and a tear strength of more than 16 N/mm.

4. The roll covering according to claim 1, wherein said at least one crosslinked hydrogenated nitrile rubber has an acrylonitrile content of from 20% to 50% by weight.

5. The roll covering according to claim 1, wherein said rubber component of said rubber composition is composed entirely of one crosslinked hydrogenated nitrile rubber or of two or more different crosslinked hydrogenated nitrile rubbers.

6. The roll covering according to claim 1, wherein said rubber component of the rubber composition comprises, in addition to the at least one crosslinked hydrogenated nitrile rubber, at least one other rubber which differs from crosslinked hydrogenated nitrile rubber selected from the group consisting of crosslinked nitrile rubbers, crosslinked carboxylated nitrile rubbers, crosslinked styrene-butadiene rubbers, and any desired copolymers and/or mixtures of two or more of the crosslinked rubbers.

7. The roll covering according to claim 6, wherein said rubber component comprises from 1 to 60% by weight of one or a plurality of different, crosslinked hydrogenated nitrile rubber(s), and from 40 to 99% by weight of one or more rubbers selected from the group consisting of crosslinked nitrile rubbers, crosslinked carboxylated nitrile rubbers, crosslinked styrene-butadiene rubbers, and any desired copolymers and/or mixtures of two or more of these crosslinked rubbers.

8. The roll covering according to claim 6, wherein said rubber component comprises from 15 to 40% by weight of one or a plurality of different, crosslinked hydrogenated nitrile rubbers, and from 60 to 85% by weight of one or more rubbers selected from the group consisting of crosslinked nitrile rubbers, crosslinked carboxylated nitrile rubbers, crosslinked styrene-butadiene rubbers, and any desired copolymers and/or mixtures of two or more of these crosslinked rubbers.

9. The roll covering according to claim 1, wherein said at least one (meth)acrylate compound is selected from the group consisting of zinc monoacrylates, zinc diacrylates, zinc monomethacrylates, zinc dimethacrylates, lithium acrylates, lithium methacrylates, sodium acrylates, sodium methacrylates, potassium acrylates, potassium methacrylates, magnesium acrylates, magnesium methacrylates, calcium acrylates, calcium methacrylates, aluminum acrylates, aluminum methacrylates, copper acrylates, copper methacrylates, ammonium acrylates, ammonium methacrylates, quaternary ammonium acrylates, quaternary ammonium methacrylates, alkyldiol monoacrylates, alkyldiol diacrylates, alkyldiol monomethacrylates, alkyldiol dimethacrylates, trimethylolpropane trimethacrylates, and any of a plurality of mixtures of two or more of these compounds.

10. The roll covering according to claim 1, wherein said at least one (meth)acrylate compound is selected from the group consisting of zinc monoacrylates, zinc diacrylates, zinc monomethacrylates, zinc dimethacrylates, butanediol dimethacrylates, trimethylolpropane trimethacrylates, and any of a plurality of mixtures of two of more of these compounds.

11. The roll covering according to claim 1, wherein said rubber composition comprises, based on 100 parts by weight of said rubber component, from 1 to 20 parts by weight of said at least one (meth)acrylate compound.

12. The roll covering according to claim 1, wherein said rubber composition further comprises, based on 100 parts by weight of the rubber component, from 1 to 150 parts by weight of carbon black.

13. The roll covering according to claim 12, wherein said carbon black has a specific BET surface area of from 5 to 120 $m^2/g$.

14. The roll covering according to claim 1, wherein said rubber composition further comprises, based on 100 parts by weight of said rubber component, from 1 to 100 parts by weight of silica.

15. The roll covering according to claim 14, wherein said silica has a specific BET surface area of from 5 to 210 $m^2/g$.

16. The roll covering according to claim 1, wherein said rubber composition further comprises at least one filler and/or one additive selected from the group consisting of plasticizers, antioxidants, resins, polymer fillers, pigments and any of a plurality of mixtures of two or more of the aforementioned compounds.

17. The roll covering according to claim 16, wherein said rubber composition comprises, based on 100 parts by weight of said rubber component, from more than 0 to 80 parts by weight of at least one resin.

18. The roll covering according to claim 16, wherein said rubber composition comprises, based on 100 parts by weight of said rubber component, from more than 0 to 80 parts by weight of at least one polymer filler selected from the group consisting of polyolefins, polyamides, polyurethanes, polyesters, rubbers, and any of a plurality of mixtures of two or more of the polymer fillers.

19. The roll covering according to claim 1, wherein said at least one layer is an outer layer of the roll covering and has a thickness of from 5 to 25 mm.

* * * * *